United States Patent [19]

Cook, III et al.

[11] 3,948,190

[45] Apr. 6, 1976

[54] INDUSTRIAL LOAD-CARRYING PALLET

[75] Inventors: James M. Cook, III, Bloomfield Hills; Edward K. Tazzia, East Detroit, both of Mich.

[73] Assignee: Oakland Plastics Corporation, Troy, Mich.

[22] Filed: Oct. 4, 1974

[21] Appl. No.: 512,140

[52] U.S. Cl. ..... 108/53; 108/55; 206/505; 214/10.5 R

[51] Int. Cl.[2] ..... B65D 19/24; B65D 19/44

[58] Field of Search ..... 100/51, 53, 55, 58; 206/501, 503, 505, 511; 214/10.5 R

[56] References Cited

UNITED STATES PATENTS

| | | | |
|---|---|---|---|
| 2,444,326 | 6/1948 | Baker et al. | 108/55 |
| 3,319,799 | 5/1967 | Paxton | 108/53 X |
| 3,433,184 | 3/1969 | Addy | 108/53 |
| 3,526,195 | 9/1970 | Marvonovich | 108/53 |
| 3,654,875 | 4/1975 | Vik | 108/53 |
| 3,664,272 | 5/1972 | Sanders | 108/53 |
| 3,702,100 | 11/1972 | Wharton | 108/53 X |
| 3,768,423 | 10/1973 | Cook et al. | 108/51 |

FOREIGN PATENTS OR APPLICATIONS

| | | | |
|---|---|---|---|
| 1,268,059 | 9/1968 | Germany | 108/51 |

*Primary Examiner*—Roy D. Frazier
*Assistant Examiner*—William E. Lyddane
*Attorney, Agent, or Firm*—McGlynn and Milton

[57] ABSTRACT

An industrial load-carrying pallet comprising an integral sheet of material formed with strengthening ribs extending thereacross, three centrally disposed pedestals extending downwardly at the center line and generally W-shaped pedestals disposed adjacent the side extremities. Grooves extend downwardly from the upper surface and are disposed along the circumference of four circles for receiving the bottom rims of four drums. The pedestals have recesses therein disposed on the circumference of four circles whereby the pedestals may rest upon and engage the top rims of four drums. The area of the top surface within each circle for receiving the bottom rim of a drum is spherically concave. The side pedestals have spaced converging walls in a downward direction which are joined at the lower extremities by a bottom base. Empty pallets may be stacked by placing the pedestals within one another. However, there is included anti-locking means in the form of shoulders extending inwardly from the side walls of the side pedestals to engage bottom base of a like pedestal of another pallet to prevent stacked pallets from being wedged into binding engagement with one another.

16 Claims, 8 Drawing Figures

INDUSTRIAL LOAD-CARRYING PALLET

This invention relates to new and useful improvements in industrial pallets and, more particularly, to pallets which are unitarily formed of a sheet of plastic material for storing and transporting large containers such as drums.

There are known pallets which are fabricated for especially receiving containers such as drums. Examples of such are shown in U.S. Pat. Nos. 3,628,468 and 3,636,888. The pallets shown in these patents are of relatively complex configuration and relatively expensive to fabricate.

Pallets are also known in the prior art which may be stacked one on top or one within the other in the empty condition. Examples of such pallets are shown in U.S. Pat. Nos. 2,916,239; 3,611,952 and 3,641,949. A problem with many prior art pallets which may be stacked when empty is that the pallets bind together and it is difficult to separate such stacked or nested pallets.

The subject invention involves a pallet especially formed for receiving drums which is inexpensive and easily formed, as it is made of one integral sheet of material. The pallet has strengthening ribs extending across the pallet and a plurality of grooves in the upper surface disposed on the circumference of a plurality of circles for receiving the bottom rims of drums. Pedestals extend downwardly to define the lower extremities of the pallet and include recesses disposed on the circumference of circles for resting upon the top rims of a plurality of drums. Some of the pedestals have spaced side walls which converge toward one another as they extend downwardly to a bottom base interconnecting the side walls. Shoulders extend inwardly from the side walls for engaging the bottom bases of like pallets to prevent the pallets from being wedged into binding engagement with one another. Thus, the instant invention provides an integral simply fabricated pallet having the requisite strength characteristics for supporting drums and includes other desired pallet features.

Other advantages of the present invention will be readily appreciated as the same becomes better understood by reference to the following detailed description when considered in connection with the accompanying drawings wherein.

Figure 1:
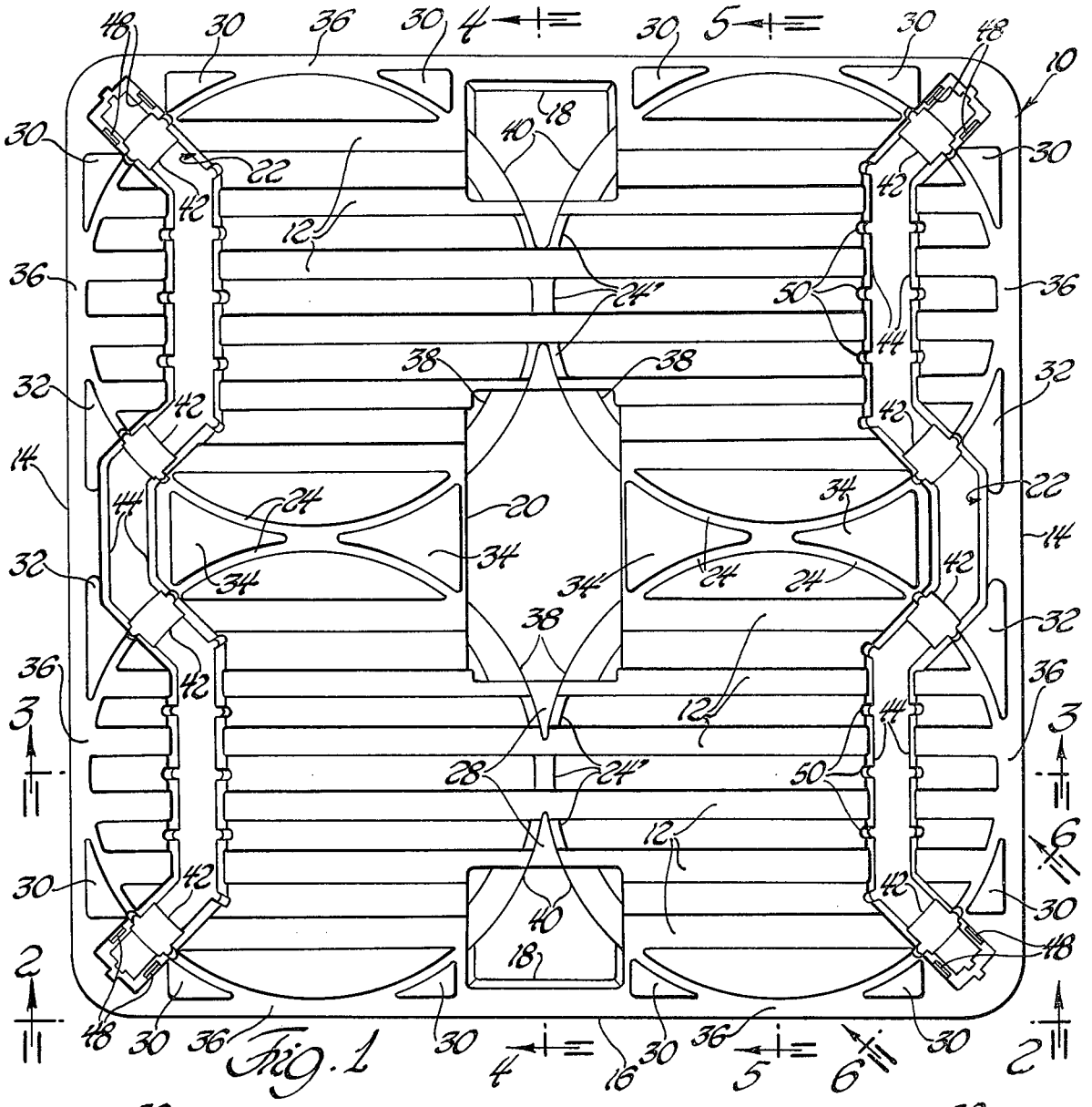
FIG. 1 is a plan view of the top of a pallet constructed in accordance with the instant invention.
Figure 2:
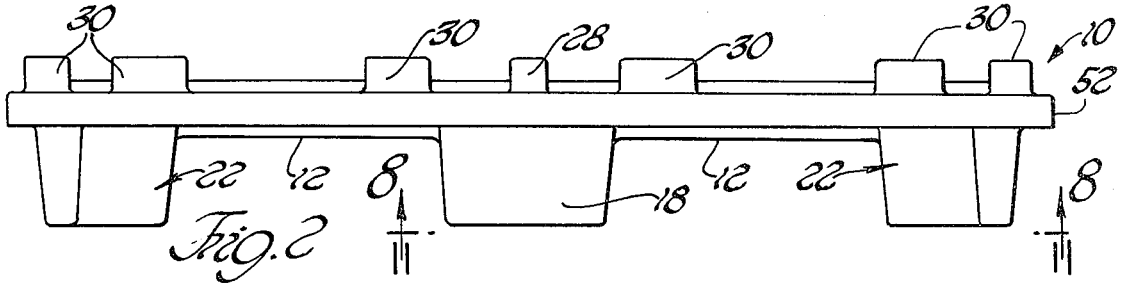
FIG. 2 is a side view taken along line 2—2 of FIG. 1.

Referring now to the drawings wherein like numerals indicate like or corresponding parts throughout the several views, a pallet constructed in accordance with the instant invention is generally shown at 10. The pallet 10 is an industrial load-carrying pallet comprising an integral plastic sheet of material defining a top area on the upper face and a bottom area on the opposite face. The pallet may be made of various known and suitable plastics by any one of various known molding techniques.

A plurality of ribs 12 are formed in this sheet and extend downwardly thereinto from the top area. The sheet of material defining the pallet has side extremities 14 interconnected by end extremities 16, although the pallet is preferably square, as viewed in plan. The ribs 12 are generally parallel to one another and extend perpendicularly to the side extremities 14. As will be appreciated from viewing the drawings, the ribs 12 are of different lengths.

A plurality of support pedestals are formed in this sheet and extend downwardly thereinto from the top area to define lower extremities disposed below the ribs 12. More particularly, the pedestals include a plurality of spaced center pedestals 18 and 20 disposed along the center line extending parallel to the side extremities 14, the center line being represented by line 4—4 in FIG. 1. The pedestals also include an elongated side pedestal generally indicated at 22 extending between the end extremities 16 along each side extremity 14. Each of the elongated side pedestals 22 is generally W-shaped, as viewed in plan and from the center of the top area or the center of the pedestal 20. In other words, the distal legs or extremities of the W-shaped pedestals 22 extend outwardly from the center line extending through the central pedestals 18 and 20.

The center pedestals 18 and 20 are spaced from the side pedestals 22 so that the tongs of a lifting vehicle may be inserted on either side of the center pedestals 18 and 20 and in a direction generally parallel to the side extremities 14 for lifting the pallet. The center pedestals 18 and 20 include a central pedestal 20 disposed at the center of the top area of the pallet and two end pedestals 18, each disposed adjacent one of the end extremities 16. The center pedestals 18 and 20 are generally rectangular as viewed in plan, however, they are of the same dimension in a direction parallel to the end extremities 16 with the end pedestals 18 being elongated in a direction parallel to the end extremities 16, whereas the central pedestal 20 is elongated in a direction parallel to the side extremities 14.

A plurality of grooves 24 and 24' are formed in the sheet and extend downwardly thereinto from the top area. The grooves 24 and 24' are arcuate and disposed on the circumference of a grooved circle so that they may receive the bottom rim of a drum. In other words, there are a plurality of grooves 24 and 24' which are segments of a grooved circle for receiving the bottom rim of a drum. Specifically, there are four grooved circles formed by the grooves 24 and 24' for receiving four drums.

Figure 3:
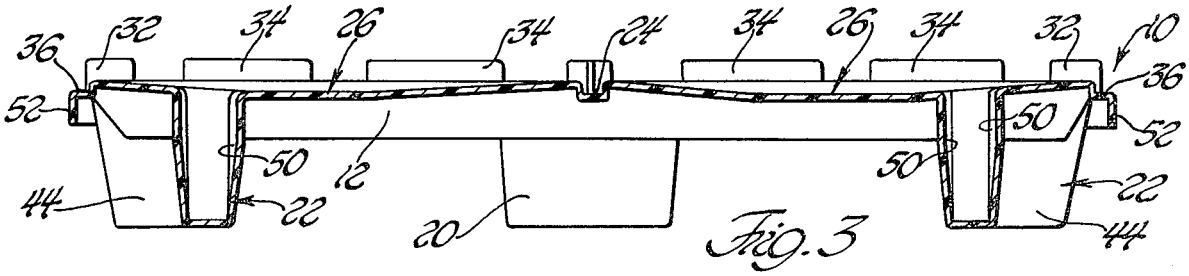
FIG. 3 is a cross-sectional view taken substantially along line 3—3 of FIG. 1.
Figure 4:
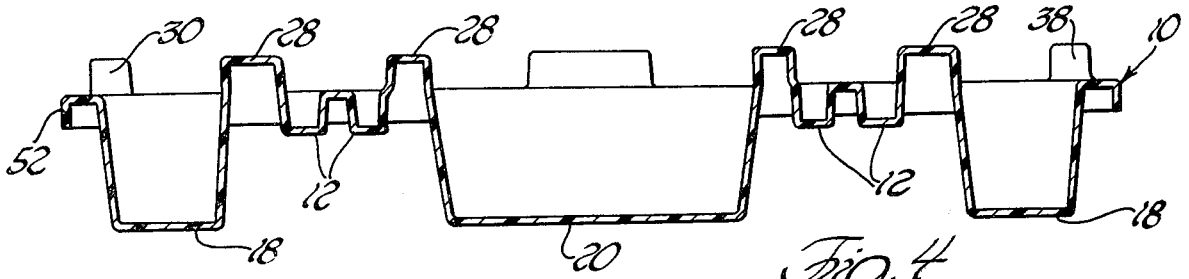
FIG. 4 is a cross-sectional view taken substantially along line 4—4 of FIG. 1.
Figure 5:
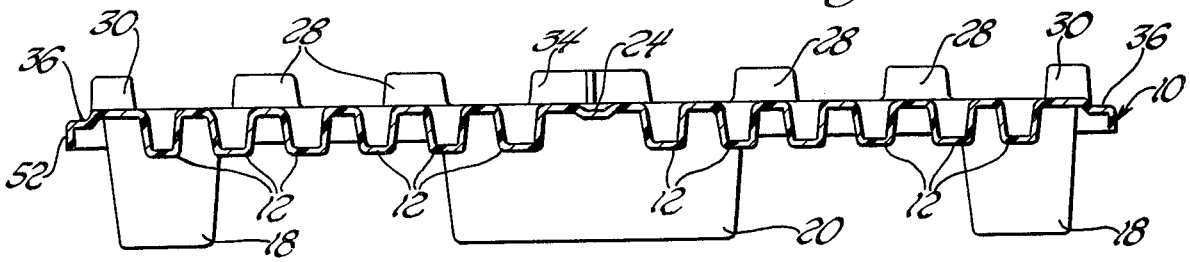
FIG. 5 is a cross-sectional view taken substantially along 5—5 of FIG. 1.
Figure 6:
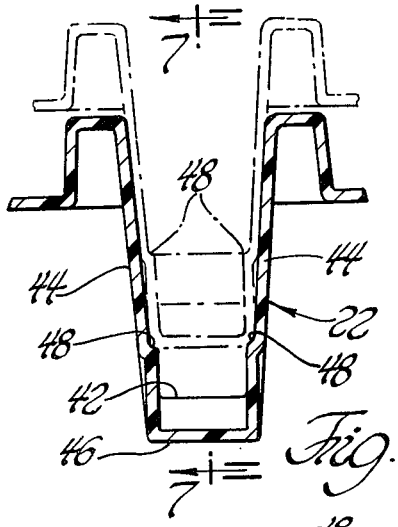
FIG. 6 is a view taken substantially along line 6—6 of FIG. 1 with the additional showing in phantom of a portion of a like pallet in nested or stacked relationship.
Figure 7:
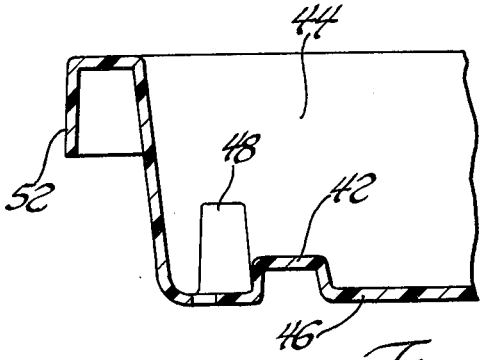
FIG. 7 is a fragmentary cross-sectional view taken substantially along line 7—7 of FIG. 6.
Figure 8:
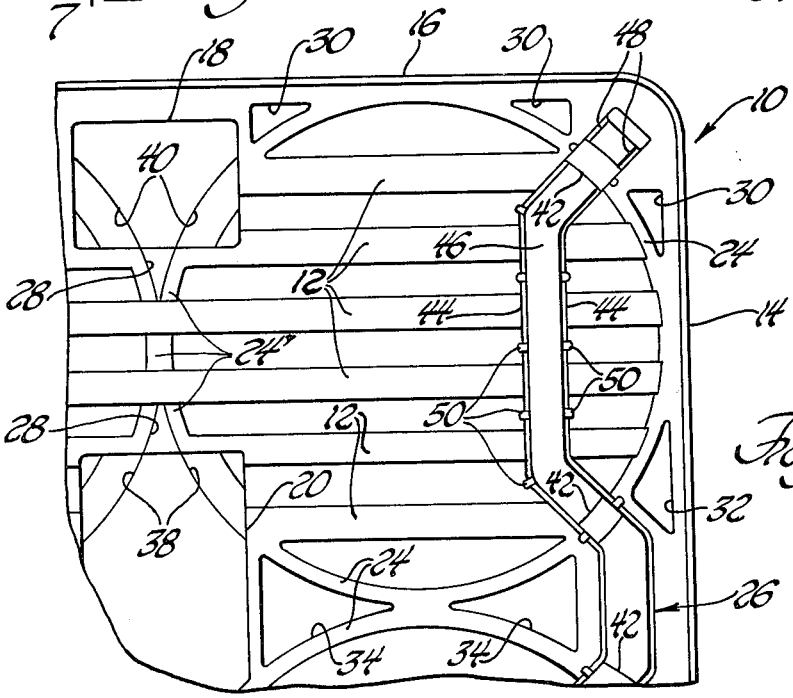
FIG. 8 is a fragmentary bottom view taken substantially along 8—8 of FIG. 2.

As best shown in FIG. 3, the upper extremities of the top area of the sheet between the ribs 12 and within each of the grooved circles is spherically concave as generally indicated at 26. The spherical concaveness is provided to receive the outwardly bulging bottom of a full drum and allows the pallet to maintain its structural integrity.

There is also included a plurality of raised abutments 28, 30 and 32 extending upwardly on the top area. Each of the abutments 28, 30 and 32 is disposed about or on the exterior of one of the grooved circles and have at least one arcuate wall concentric with a grooved circle for engaging the outer periphery of a drum. The abutments 30 and 32 have but one such arcuate wall whereas abutments 28 and 34 each have two such arcuate walls facing adjacent groove circles.

The top area includes a plurality of roll-out surfaces 36, each of which is an extension of the bottom of one of the grooves 24 to an adjacent one of the extremities 14 or 16 for allowing the drum to be tilted and rolled out of each groove by being rolled over one of the roll-out surfaces 36. In other words, the surfaces 36 are level with or in a horizontal plane with the bottom of the grooves 24 whereby a barrel or drum may be tipped and rolled on the surface 36 to be removed from the pallet. If such surfaces were not provided, each drum would have to be lifted out of the grooves.

The pedestals 18, 20 and 22 have recesses extending thereinto from the lower extremities for receiving the top rim of a drum. The recesses are disposed on the circumference of a plurality of recessed circles whereby each recessed circle may receive the top rim of a drum. Specifically, there are four such recessed circles and each of the recessed circles is concentric to one of the grooved circles defined by the grooves 24 and 24'. Specifically, the central pedestal 20 includes one of said recesses 38 across each corner thereof. Additionally, the end pedestals 18 each include one of the recesses 40 across each of the two inward corners thereof. In other words, the recesses 40 extend across the corners of the pedestals 18 which face inwardly toward the pedestal 20. It will be noted that the recesses 38 and 40 are arcuate. The side pedestals 22 each have four recesses 42 therein. Each recess 38 at each corner of the central pedestal 20 is disposed on one of the recessed circles along with one of the recesses 40 in an adjacent pedestal 18 and two of the recesses 42 in an adjacent side pedestal 22 whereby there is included four recessed circles. The recessed circles engage top rims of drums for preventing movement of a pallet disposed upon such drums. This allows one drum loaded with pallets to be stacked upon another pallet loaded with drums.

The side pedestals 22 have spaced side walls 44 which converge in a downward direction and are joined by a bottom base 46. There is included anti-locking means for preventing stacked or nested empty pallets from binding together when stacked with pedestals of one pallet disposed in the pedestals of another. More specifically, the anti-locking means includes a plurality of shoulders 48 disposed in spaced relationship above the bottom base 46 and extending inwardly from the side walls for engaging and supporting the bottom base of the pedestal of a like pallet, thereby preventing the nested or stacked pallets from coming into full wedging engagement with one another. Specifically, the shoulders 48 are indentations or inward bulges in the side walls of the pedestals 22 adjacent the ends thereof, as best illustrated in FIG. 1.

Additionally, the side pedestals 22 include reinforcing raised portions or ribs 50 which add strength to the pedestals 22.

There is also included an edge flange 52 extending downwardly about the periphery of the top area or along the extremities 14 and 16.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

The embodiments of the invention in which an exclusive property or privilege is claimed are defined as follows:

1. An industrial load-carrying pallet comprising; an integral sheet of material defining a top area on one face and a bottom area on the opposite face, a plurality of ribs formed in said sheet and extending downwardly thereinto from said top area, a plurality of support pedestals formed in said sheet and extending downwardly thereinto from said top area to lower extremities disposed below said ribs, a plurality of grooves formed in said sheet and extending downwardly thereinto from said top area, each of said grooves being arucate and disposed on the circumference of a groove circle for receiving the bottom rim of a drum, said pedestals having recesses extending thereinto from said lower extremities for receiving the top rim of a drum, said recesses being disposed on the circumference of a plurality of recess circles whereby each recess circle may receive the top rim of a drum, each of said groove circles being concentric to one of said recess circles, said pedestals including an elongated side pedestal along each of the opposite side extremities, each of said elongated side pedestals being generally W-shaped as viewed in plan and from the center of said pallet, some of said recesses extending across said side pedestals.

2. A pallet as set forth in claim 1 wherein the upper extremities of said top area between said ribs within each of said groove circles defined by said grooves is spherically concave.

3. A pallet as set forth in claim 1 wherein a plurality of said pedestals have spaced side walls which converge in a downward direction and are joined by a bottom base, and including anti-locking means for preventing stacked empty pallets from binding together when stacked with the pedestals of one pallet disposed in the pedestals of another pallet.

4. A pallet as set forth in claim 3 wherein said anti-locking means includes a plurality of shoulders disposed above said bottom base and extending inwardly from said side walls for engaging and supporting the bottom base of the pedestal of a like pallet thereby preventing stacked pallets from coming into full wedging engagement with one another.

5. A pallet as set forth in claim 1 wherein said side extremities are connected by end extremities, and said ribs are generally parallel and extend perpendicularly to the side extremities.

6. A pallet as set forth in claim 5 wherein pedestals include a plurality of spaced center pedestals disposed along the centerline extending parallel to said side extremities.

7. A pallet as set forth in claim 6 wherein said center pedestals are spaced from said side pedestals so that the tongs of a lifting vehicle may be inserted on either side of said center pedestals in a direction parallel to said side extremities.

8. A pallet as set forth in claim 7 wherein said center pedestals include a central pedestal disposed at the center of said top area and two end pedestals each disposed adjacent one of said end extremities.

9. A pallet as set forth in claim 8 wherein each of said center pedestals are generally rectangular as viewed in plan.

10. A pallet as set forth in claim 9 wherein said central pedestal includes one of said recesses across each corner thereof, said end pedestals each include one of said recesses across each of the two inward corners thereof, each of said side pedestals having four of said recesses therein.

11. A pallet as set forth in claim 10 wherein each recess at each corner at said central pedestal is disposed on one of said recess circles along with one of said recesses in an adjacent end pedestal and two of said recesses in an adjacent side pedestal whereby there is included four such recess and groove circles.

12. A pallet as set forth in claim 11 including a plurality of raised abutments extending upwardly on said top area, each of said abutments being disposed about at least one of said groove circles and having at least one arcuate wall concentric with a groove circle for engaging the outer periphery of a drum.

13. A pallet as set forth in claim 12 wherein said top area includes a plurality of roll-out surfaces, each of which is an extension of the bottom of one of said grooves to an adjacent one of said extremities for allowing a drum to be tilted and rolled out of each groove by being rolled over one of aid roll-out surfaces.

14. A pallet as set forth in claim 13 wherein said side pedestals have spaced side walls which converge in a downward direction and are joined by a bottom base, and including anti-locking means for preventing stacked empty pallets from binding together when stacked with pedestals of one pallet disposed in the pedestals of another.

15. A pallet as set forth in claim 14 wherein said anti-locking means includes a plurality of shoulders disposed above said bottom base and extending inwardly from said side walls for engaging and supporting the bottom base of the pedestal of a like pallet thereby preventing stacked pallets from coming into full wedging engagement with one another.

16. A pallet as set forth in claim 15 including an edge flange extending downwardly about the periphery of said top area.

* * * * *